United States Patent [19]

Fedechko

[11] 4,237,024

[45] Dec. 2, 1980

[54] DISHWASHING COMPOSITION AND METHOD OF MAKING THE SAME

[75] Inventor: Walter J. Fedechko, Williamstown, N.J.

[73] Assignee: Certified Chemicals, Inc., Cinnaminson, N.J.

[21] Appl. No.: 916,407

[22] Filed: Jun. 16, 1978

[51] Int. Cl.[2] ..... C11D 7/54; C11D 7/56

[52] U.S. Cl. ..... 252/99; 252/135; 264/117; 264/118; 23/313R

[58] Field of Search ..... 252/99, 135; 264/117, 264/118; 23/313

[56] References Cited

U.S. PATENT DOCUMENTS

| | | | |
|---|---|---|---|
| 3,491,028 | 1/1970 | Crotty et al. | 252/99 |
| 3,741,904 | 6/1973 | Christensen et al. | 252/99 |
| 3,817,869 | 6/1974 | Ries et al. | 252/99 |
| 3,825,498 | 7/1974 | Altenschopter et al. | 252/99 |
| 3,826,748 | 7/1974 | Finck | 252/99 |
| 3,852,209 | 12/1974 | Hofmann | 252/99 |
| 3,888,781 | 6/1975 | Kiwgry | 252/99 |
| 3,933,670 | 1/1976 | Brill et al. | 252/99 |
| 3,966,627 | 6/1976 | Gray | 252/99 |
| 4,077,897 | 3/1978 | Gault | 252/99 |

*Primary Examiner*—Mayer Weinblatt

*Attorney, Agent, or Firm*—Seidel, Gorda, Goldhammer & Panitch

[57] ABSTRACT

A method of making a dishwashing composition and the composition so produced comprises mixing an aqueous solution of sodium hypochlorite with substantially dry ingredients including phosphates known as sequestering agents or builder salts and a carrier material. An alkali metal silicate is also added in substantially dry form and/or as an aqueous solution. Agitation is continued until agglomerated granules of the desired size are attained. Following agglomeration, the composition is conditioned to reduce the moisture content resulting in a substantially dry, granular dishwashing composition. Preferably, a low foam non-ionic surfactant is sprayed onto the granules before the composition is packaged.

21 Claims, No Drawings

DISHWASHING COMPOSITION AND METHOD OF MAKING THE SAME

BACKGROUND OF THE INVENTION

This invention relates to a method of making a dishwashing composition and the dishwashing composition so produced. The composition is primarily intended for use with both residential and commercial automatic dishwashers. The agglomerated granules produced in accordance with the method of the present invention form a very stable product having excellent flow characteristics and a high degree of uniformity among the particles forming the composition.

The dishwashing composition of the present invention accomplishes its primary purpose of thoroughly cleaning dishes, pots, pans, silverware and the like while exhibiting excellent corrosion inhibition and fine china overglaze protection. Excellent results are consistently obtained due to the uniformity of the distribution of components among the agglomerated particles formed by the method of the present invention. A feature of the present invention is the use of an aqueous solution of sodium hypochlorite which provides a uniform amount of available chlorine to the dishwashing granules.

Prior art attempts to combine excellent cleaning properties with overglaze protection and corrosion inhibition properties in automatic dishwashing compositions have had varying degrees of success. The method and composition of the present invention are neither disclosed nor suggested by any of the following patents which are believed to represent the closest prior art.

U.S. Pat. No. 3,491,028 of Crotty et al. discloses a dishwashing composition comprising an alkaline material which may be an alkaline builder, or a combination of an alkaline builder and a caustic material, and a chlorinating agent which may be lithium hypochlorite, or lithium hyphochlorite in combination with sodium or potassium dichlorocyanurate. Some of the preferred embodiments include sodium orthosilicate or sodium metasilicate. It is stated at column 3, lines 32–34, that it is essential in formulating the composition that all ingredients be kept as dry as possible prior to mixing. This patent teaches away from the present invention wherein the chlorinating agent is formed from an aqueous solution of sodium hypochlorite.

U.S. Pat. No. 3,817,869 of Ries et al. discloses a substantially sequestrant-free dishwashing composition comprising an ionizable salt, an alkali metal silicate, a chlorine-yielding bleach and a nonionic synthetic detergent. The preferred method of forming the compositions disclosed in the patent is to simply admix all of the components to produce the final product, although other methods are merely named, including pan agglomerating, slurry or moistening of the components followed by a drying procedure. This patent teaches away from the use of sequestrant builder salts as used in the present invention and does not disclose or suggest the method of making the composition according to the present invention which results in a uniform product having excellent chlorine stability.

U.S. Pat. No. 3,825,498 of Altenschopfer et al. discloses a dishwashing composition which is either free of phosphates or has a greatly reduced phosphate content. The composition comprises about 90%–5% of a water soluble alkali silicate and about 5%–90% of a polyhydroxy carboxylic acid containing polymers built predominantly from chemical units unrelated to the present invention. The method used to form the patented composition is quite dissimilar from the method of the present invention.

U.S. Pat. No. 3,826,748 of Finck discloses a non-phosphate dishwashing composition containing a water soluble aminopolycarboxylic compound, sucrose and an overglaze protector such as aluminum acetate, aluminum formate, alkali metal aluminum orthophosphates, alkali aluminate, zincate and berylliate, boric acid, boric anhydride, and mixtures thereof. The compositions may contain a bleaching agent capable of liberating hypochlorite chlorine and/or hypobromite bromine on contact with aqueous media, as well as nonionic surface active agents. Brominated and chlorinated trisodium phosphate, a dry product formed by the reaction of the corresponding sodium hypohalite solution with trisodium phosphate (and water as necessary), is listed among a large number of other hypohalite-liberating agents. It is stated at column 5, lines 43–46 that the compositions according to the patent are usually prepared by dry blending the ingredients to form a dry particulate product such as a free flowing granular composition or powder. This statement teaches away from the use of an aqueous solution of sodium hypochlorite as a separate ingredient in the preparation of the patented compositions. In addition, the patent teaches away from the present invention by excluding phosphates from the composition.

U.S. Pat. No. 3,852,209 of Hofmann has a disclosure which is substantially identical to U.S. Pat. No. 3,826,748. This patent is also concerned with a phosphate-free dishwashing composition prepared by dry blending the ingredients (column 5, lines 60–63). Accordingly, this patent may be distinguished from the present invention for the same reasons as U.S. Pat. No. 3,826,748.

U.S. Pat. No. 3,966,627 of Gray discloses a dishwashing composition directed to the problem of overglaze attack. The composition comprises a major proportion of a water soluble builder salt, an aluminum silicate and may include various types of detergents and hypohalite-liberating agents, such as those disclosed in U.S. Pat. Nos. 3,826,748 and 3,852,209. It is stated at column 8, lines 22–26 that there is nothing critical in the selection of the bleaching agent. Furthermore, this patent does not disclose what methods are used to form the patented compositions and, accordingly, neither anticipates nor renders the present invention obvious.

In contrast, the present invention results from the discovery that an aqueous solution of sodium hypochlorite can be used to produce a stable, uniform and effective dishwashing composition.

SUMMARY OF THE INVENTION

The present invention comprises a dishwashing composition and a method of making it comprising the steps of:

(a) mixing an aqueous solution of sodium hypochlorite at a rate of about 4 to about 25% per minute based on the total weight of any substantially dry ingredients in an amount effective to decompose and oxidize dishware soil with at least one sequestrant builder salt, a carrier material and an alkali metal silicate to form a composition mixture;

(b) agitating said composition mixture after adding the ingredients set forth in step (a) for a sufficient time to form agglomerated granules of the composition mixture; and (c) conditioning the agglomerated granules by reducing the moisture content of agglomerated granules by about 0.25–5%.

The composition preferably includes about 1 to about 4% of a low foam nonionic surfactant which is sprayed onto the conditioned particles of the composition.

The dishwashing composition formed in accordance with this method has excellent cleansing, corrosion inhibition, overglaze protection and flow properties. Almost every agglomerated granule has a uniform and homogeneous composition. The agglomerated composition of this invention will not segregate into its individual raw materials, even after prolonged storage.

DETAILED DESCRIPTION OF THE PREFERRED EMBODIMENTS

This invention relates to a dishwashing composition for residential and industrial automatic dishwashers. The composition of this invention is an excellent cleanser, does not form soapy films on dishware, does not corrode silverware, pots and pans or the metal components of the dishwasher, does not adversely affect the overglaze found on dishes, even fine china, and has a sheeting action to eliminate almost all spots from the cleaned dishware. These characteristics can be achieved by using a sodium hypochlorite solution as the source of available chlorine in accordance with the present invention. In addition to these favorable characteristics, the composition is a very uniform, homogeneous and stable agglomerated product having excellent flow properties.

As used herein, "percent" and "%" are defined to mean percent by weight of the total final composition unless otherwise indicated or unless it is clear from the context what it means, as in concentrations of solutions.

Alkaline sequestrant builder salts in an amount of about 30% to about 47% are used in the present invention for their ability to form coordination complexes with metallic ions present in hard water so that the usual precipitation reactions of the metal ions are prevented. The ions causing the hardness in the water may interact with food soils so that they are hard to remove from dishes, or otherwise render the composition less effective.

The sequestrant builder salts used in the present invention are the typical phosphate compounds, and preferably include sodium tripolyphosphate, trisodium phosphate, tetrasodium pyrophosphate, tetrapotassium pyrophosphate, sodium hexametaphosphate and mixtures thereof. The amount of builder salts is selected so that the phosphate content of the compositions produced in accordance with the present invention and the effluents after use are within the limits set forth in federal, state and local statutes and regulations. It is presently preferred to use about 25% to about 35% sodium tripolyphosphate and about 5% to about 12% trisodium phosphate. Optimum percentages of these ingredients include about 30% sodium tripolyphosphate and about 7% trisodium phosphate. The sequestrant builder salts used in the present invention are substantially dry ingredients.

As used herein, "substantially dry ingredient" is defined to mean a free-flowing dry ingredient.

Water soluble carrier materials which are inert with respect to the other ingredients of the composition are mixed in with the sequestrant builder salts. About 25% to about 40% of the carrier material is used in the present invention to aid in the formation of agglomerated particles.

The carrier materials which are preferably present in the compositions of the present invention in an amount of about 25% to about 40% include: sodium chloride, potassium chloride, sodium carbonate, potassium carbonate, sodium sulfate, potassium sulfate, sodium bicarbonate, borax or mixtures thereof. These are preferred carrier materials. Other carrier materials may be used, as is well known to those skilled in the art. It is presently preferred to use about 34.5% sodium chloride as the carrier material.

In addition to the sequestrant builder salts and the carrier material, another substantially dry ingredient may be sodium silicate or potassium silicate or mixtures thereof, preferably having a $SiO_2:M_2O$ ratio of about 1:1 to about 3.22:1, and, as presently preferred, about 2.4:1, wherein M is sodium, potassium or mixtures thereof.

The alkali metal silicate need not be present in substantially dry form, but may be present as an aqueous solution. It is preferred that the total alkali metal silicate present in the composition be about 6% to about 24%. It is preferred that about 5% to about 14% be derived from an aqueous solution of sodium silicate, potassium silicate or mixtures thereof, and about 1% to about 10% be substantially dry sodium silicate, potassium silicate or mixtures thereof. A presently preferred embodiment contains about 1.6% sodium silicate derived from a substantially dry sodium silicate and about 8% derived from an aqueous solution of sodium silicate. Although the concentration of alkali metal silicate in water may be any suitable concentration, aqueous solutions of alkali metal silicate are available in concentrations of about 38% to about 55% alkali metal silicate in the solution, 47% being presently preferred.

The alkali metal silicate provides overglaze protection for the dishes and china and corrosion inhibition properties to protect the dishwasher machine as well as the silverware or other dinnerware, including pots and pans. The alkali metal silicate also increases the alkalinity of the composition and has a synergistic effect on the detergency of the composition.

An aqueous solution of sodium hypochlorite is used to make the composition according to the present invention. The aqueous solution of sodium hypochlorite is an excellent source of available chlorine in the composition of the present invention. Available chlorine from the composition helps to break down soil particles and enhances water sheeting, thus improving performance. The sodium hypochlorite may also be an effective sanitizer when used in sufficient strength.

As used herein, "available chlorine" measures the oxidizing power of the oxidizing agent, here, an aqueous solution of sodium hypochlorite, which is equivalent to the oxidizing power of $Cl_2$. When $Cl_2$ is used to oxidize a substance, the following reaction occurs: $Cl_2 \rightarrow 2Cl^{-1}$. Thus there is a total change in valence of 2, from two zeros to two minus ones. The $Cl^{-1}$ ion, as in NaCl, has very little oxidizing power and is of no value as an oxidizing agent. However, in NaOCl, the Cl ion has a valence of +1. When the Cl ion oxidizes another substance, it ends up as a chloride ion having a valence of −1, a valence change of 2, from $Cl^{+1}$ to $Cl^{-1}$. Thus, the chlorine held in the hypochlorite ion, $OCl^{-1}$, has the same availability for oxidizing as one molecule of $Cl_2$. The weight percent available chlorine in NaOCl is calculated by dividing the weight percent of NaOCl by 1.05.

The essence of this invention is the use of an aqueous solution of sodium hypochlorite, rather than other similar solid products, such as lithium hypochlorite or calcium hypochlorite. The use of the aqueous solution of sodium hypochlorite produces a uniform and homogeneous composition providing a stable source of available chlorine. The aqueous solution of sodium hypochlorite aids in forming agglomerated particles of uniform composition in one step, combining chlorination, hydration and agglomeration. The composition will not separate into its individual components even after prolonged storage.

A sufficient amount of an aqueous solution of sodium hypochlorite should be present in the composition to yield an adequate amount of available chlorine to provide effective soil decomposition and oxidizing action. An available chlorine content of about 0.25% to about 1.6% is generally effective to produce these results. It is presently preferred to use a sufficient amount of the aqueous solution of sodium hypochlorite to yield about 0.4% to about 1.2% available chlorine in the composition. A presently preferred embodiment contains a sufficient amount of aqueous sodium hypochlorite solution to yield about 1% available chlorine in the final composition. Although the concentration of sodium hypochlorite in water may be any suitable concentration, aqueous solutions of sodium hypochlorite are frequently and conveniently available in concentrations of about 5% to about 16% sodium hypochlorite in the solution, 13% being presently preferred.

The available chlorine from the aqueous solution of sodium hypochlorite also enhances "water sheeting". "Water sheeting" occurs when the soil on dishware is decomposed and the surface tension between the water and the dishware is reduced so that during rinsing of the dishware, the water flows over the dishware in a substantially uninterrupted film or sheet and not in drops or interrupted films which cause water spots and streaking.

A low foam nonionic surfactant, although a preferred ingredient, need not be used in the present invention. Low foam nonionic surfactants aid water sheeting during rinsing and draining of dishes, silverware, and the like by acting as defoaming agents and by reducing the surface tension between water and the soiled object to be cleaned.

Suitable low foam nonionic surfactants for use in the present invention are well known to those skilled in the art. Illustrative examples are disclosed in the following patents, the disclosures of which are incorporated herein by reference: U.S. Pat. No. 3,817,869 of Ries et al. (column 4, lines 1-60); U.S. Pat. No. 3,852,209 of Hofmann (column 4, line 44-column 5, line 27).

When desired, it is preferred to use about 1% to about 4% of the low foam nonionic surfactant. A presently preferred embodiment uses about 2% of a straight chain primary aliphatic oxy-ethylated alcohol available as RA-43 from B.A.S.F. Wyandotte Corp.

Optional ingredients which may be used with the compositions of the present invention include the usual additives which do not interfere with the cleaning, overglaze protection or corrosion inhibiting properties of the composition, such as perfume, fillers, extenders, pigments, dyes, anti-tarnishing agents, foam depressants, foam builders, anti-redeposition agents, polyelectrolytes which act as soil suspending and/or peptizing agents including polycarboxylates, polyamino-methyl phosphonate, maleic anhydride acrylic acid polymer, starch degradation products, polymethyl vinyl ether/-maleic acid, chelating agents and the like.

The method of the present invention used in forming the composition will now be described. The method is suitable for use as either a batch process or a continuous process for producing the dishwashing composition. None of the steps of the process is critical to the formation of the present composition unless otherwise indicated.

Appropriate amounts of the substantially dry ingredients as described above are preferably mixed together in any desired order, although it is not necessary to premix the substantially dry ingredients. The substantially dry ingredients include the sequestrant builder salts, the carrier material, and any substantially dry alkali metal silicate. The ingredients preferably are mixed until a relatively homogeneous mixture is obtained.

The liquid component preferably comprises the aqueous solutions of sodium hypochlorite and alkali metal silicate, which preferably are blended together to form a uniform solution before they are mixed with the substantially dry ingredients. It is not critical to blend the liquid ingredients together. Thus, they may be added as separate ingredients to the substantially dry ingredients. If no alkali metal silicate solution is used, the liquid component comprises only the sodium hypochlorite solution. It is necessary to use a liquid component comprising at least sodium hypochlorite which is adsorbed on the surface of the substantially dry ingredients so that the particles adhere together, forming agglomerated particles.

It is believed that the preferred uniform mixing of the alkali metal silicate and sodium hypochlorite solutions before mixing them with the substantially dry ingredients controls the exothermic hydration rate of the substantially dry ingredients to aid in forming agglomerated particles. It is believed that the silica present in the alkali metal silicate yields protective properties to the sodium hypochlorite particularly during the formation of agglomerated particles and during conditioning of the particles. The silica seems to help stabilize the available chlorine in the composition, even when a surfactant is added.

The liquid component is added to the substantially dry ingredients to form agglomerates in a suitable mixing apparatus well known to those skilled in the art, such as a Patterson-Kelly zig-zag blender. The rate of addition of the liquid components to the substantially dry ingredients is critical to the formation of a composition comprising agglomerated particles having the desired properties and size, including excellent flow properties.

The liquid component is added in the form of a fine spray with mixing to the substantially dry ingredients at a rate of about 4% to about 25% per minute based on the weight of the substantially dry ingredients. In a presently preferred embodiment, the rate of addition of the liquid component is about 12% per minute based on the weight of the substantially dry ingredients.

When the liquid component is added to the substantially dry ingredients, chlorination and hydration occur and the particles of the composition are agglomerated all in one step. This is in contrast to prior art methods wherein builder salts are usually chlorinated in one step and then mixed with additional ingredients in another step or steps. The one step process according to the present invention for forming stable, agglomerated particles results in a reduction in energy and processing costs.

In addition to the controlled addition rate of the liquid component to the substantially dry ingredients, the temperature should be controlled so that the maximum temperature does not exceed about 120° F. The temperature rise usually can be adequately controlled by adjusting the rate of addition of the liquid component to the substantially dry ingredients, which conveniently may begin at room temperature. With certain proportions of ingredients and certain rates of addition, it may be necessary to cool the composition mixture by any suitable means well known to those skilled in the art.

After the liquid component has been added to the substantially dry ingredients, the reaction between the liquid component and the substantially dry ingredients is allowed to continue for a residence time of up to about 5 minutes, depending upon the desired size of the agglomerated granules or particles. Agglomerated granules begin to form immediately upon the addition of the liquid component to the substantially dry ingredients. During the residence time, the composition mixture is agitated until agglomerated particles of the desired size are obtained. In a presently preferred embodiment of the invention, the residence time is about 1 minute, wherein about 80% of the agglomerated granules reach a size of about minus 8 to about plus 40 mesh. After the agglomerated particles are formed, they are fairly damp, having a moisture content in the range of about 12 to about 17%.

Following agitation for the appropriate residence time, the composition mixture is conditioned by reducing its moisture content by about 0.25%-5%, and in a presently preferred embodiment, from about 15% moisture to about 14% moisture. The agglomerated particles are conditioned in a fluidizing stream of gas, preferably air, for a sufficient time to reduce their moisture content by the stated amount with a minimal loss of available chlorine. There is no critical temperature or time for conditioning so long as the temperature is not so high as to cause the decomposition of the available chlorine in the composition. The conditioning step is a critical step in producing the free flowing agglomerated particles having a stable and uniform available chlorine content.

The composition may then be put through sieves to remove fines and oversize particles. The oversize particles may be ground to the desired size and recycled. The fines may also be recycled.

Following conditioning, a low foam nonionic surfactant is preferably sprayed on the agglomerated composition. Other common additives, such as perfumes, colorants and/or the other materials described above may be added to the composition after conditioning.

The invention will now be described in more detail with reference to the following specific, non-limiting examples:

EXAMPLE 1

The following ingredients were processed in accordance with the method described below to produce a preferred embodiment of a dishwashing composition in accordance with the present invention:

| Ingredients | Parts by Weight |
|---|---|
| Substantially Dry Ingredients | |
| Sodium Tripolyphosphate | 30.0 |

-continued

| Ingredients | Parts by Weight |
|---|---|
| Trisodium Phosphate | 7.0 |
| Sodium Chloride | 34.5 |
| Sodium Silicate (81% Active) ($SiO_2$:$Na_2O$ ratio 2.4:1 | 2.0 |
| Liquid Ingredients | |
| Sodium Silicate (47% aqueous solution) ($SiO_2$:$Na_2O$ ratio 2.4:1) | 17.0 |
| Sodium Hypochlorite (13% aqueous solution) | 7.5 |
| RA-43 Low Foam Nonionic Surfactant | 2.0 |
| Total | 100.0 |

The aqueous solution of sodium silicate was mixed with the aqueous solution of sodium hypochlorite. The trisodium phosphate, sodium chloride and substantially dry sodium silicate were uniformly blended with the sodium tripolyphosphate.

The mixed liquid ingredients were added to the mixture in the form of a fine spray at a rate of about 12.25% per minute based on the weight of the mixed substantially dry ingredients and mixed with the premixed substantially dry ingredients. When the addition of the mixed liquid ingredients was complete, the agitation of the composition mixture was continued for a residence time of about 1 minute to form agglomerated granules wherein about 80% of the granules have a size between about minus 8 to about plus 40 mesh. The agglomerated granules were then transferred to a conditioning chamber and conditioned so as to reduce their moisture content from about 15% to about 14%. Final conditioning took place at room temperature and took about 48 hours.

Following the final conditioning, the low foam nonionic surfactant was sprayed onto the agglomerated particles forming the preferred composition of the present invention.

The dishwashing composition made in accordance with Example 1 has excellent flow properties, and excellent stability and uniformity of available chlorine. The composition did not become caked and performed well after six months of storage.

An independent laboratory tested a composition prepared in accordance with Example 1 in comparison with three different commercially available dishwashing compositions for aluminum corrosion, silver corrosion and fine china corrosion. The aluminum corrosion test was conducted in accordance with the method prescribed by the International Research Council. The sterling silver corrosion test was adapted from the aluminum corrosion test. The fine china corrosion test was conducted in accordance with ASTM C556-64T.

The scoring systems used in rating the corrosion properties of the various compositions are listed below:

| Corrosion of Aluminum Or Sterling Silver Scoring System | |
|---|---|
| 5 = No damage or corrosion | |
| 4 = Slight film | |
| 3 = Low to moderate pitting, discoloration, tarnish; filming moderate | |
| 2 = Moderate discoloration, tarnish, pitting | |
| 1 = Pronounced damage (blackening, deep pitting, pinholes) | |
| Acceptable Range | 4–5 |
| Marginally Acceptable | 3 |

-continued

| Corrosion of Aluminum Or Sterling Silver Scoring System | |
|---|---|
| Unacceptable | 1-2 |

| China Corrosion Scoring System | |
|---|---|
| 4 = No damage | |
| 3 = Loss of gloss (overglaze) but not pigment | |
| 2-1 = Degrees of pigment loss | |
| 0 = Complete loss of the pattern and trim | |
| Acceptable | 3-4 |
| Marginally Acceptable | 2 |
| Unacceptable | 0-1 |

The results of the testing by the independent laboratory are listed below in Table 1:

TABLE 1

| Sample | Invention (Example 1) | Commercial Product A | Commercial Product B | Commercial Product C |
|---|---|---|---|---|
| Aluminum Corrosion | very slight film score: 4.5 | very slight film score: 4.5 | very slight film score: 4.5 | very slight pitting on thin piece score: 3.5 |
| Silver Corrosion | no damage score: 5.0 | slight film score: 4.0 | very slight film score: 4.5 | very slight film score: 4.5 |
| Fine China Corrosion | | | | |
| Red China | no damage score: 4.0 | no damage Score: 4.0 | slight loss of overglaze score: 3.5 | loss of overglaze score: 3.0 |
| Flowered China | no damage score: 4.0 | no damage score: 4.0 | no damage score: 4.0 | slight loss of overglaze score: 3.5 |

The independent laboratory which conducted the tests concluded that the dishwashing composition of the present invention was as good as or better than the best of the tested commercial products (Commercial Product A) for aluminum, sterling silver and fine china corrosion protection.

EXAMPLE 2

| | Parts by Weight |
|---|---|
| Substantially Dry Ingredients | |
| Sodium Tripolyphosphate | 30.0 |
| Trisodium Phosphate | 7.0 |
| Sodium Chloride | 30.5 |
| Liquid Ingredients | |
| Sodium Silicate (47% Aqueous solution) ($SiO_2$:$Na_2O$ ratio 2.4:1) | 23.0 |
| Sodium Hypochlorite (13% Aqueous Solution) | 7.5 |
| RA-43 Low Foam Nonionic Surfactant | 2.0 |
| Total | 100.0 |

The substantially dry ingredients were premixed together. The aqueous solution of sodium hypochlorite was premixed with the aqueous solution of sodium silicate. The premixed liquid ingredients were added to the premixed substantially dry ingredients in the same manner as described with respect to Example 1. The remainder of the composition forming process was also the same as Example 1.

EXAMPLE 3

| | Parts by Weight |
|---|---|
| Substantially Dry Ingredients | |
| Sodium Tripolyphosphate | 30.0 |
| Trisodium Phosphate | 7.0 |
| Sodium Chloride | 33.5 |
| Sodium Silicate (81% Active) ($SiO_2$:$Na_2O$ ratio 2.4:1) | 12.0 |
| Liquid Ingredients | |
| Sodium Hypochlorite (13% Aqueous Solution) | 7.5 |
| Water | 10.0 |
| Total | 100.0 |

The substantially dry ingredients were premixed together. The aqueous solution of sodium hypochlorite was diluted with the water to provide more liquid to be mixed with the substantially dry ingredients, since the sodium silicate is added as a substantially dry ingredient, rather than as an aqueous solution. The premixed components were then mixed together and the remainder of the composition formation process proceeded in the same manner as Example 1.

EXAMPLE 4

The same ingredients and amounts were used in this Example as in Example 2. All of the substantially dry ingredients were added to the mixer without being premixed. The mixer was turned on and the aqueous solutions of sodium hypochlorite and sodium silicate were added to the mixer without being premixed, but at a rate of about 12% per minute based on the weight of the substantially dry ingredients. The remainder of the formation process was the same as Example 1.

EXAMPLE 5

The same ingredients and amounts were used in this Example as in Example 3. All of the substantially dry ingredients were added to the mixer without being premixed. The mixer was turned on and the water and sodium hypochlorite solution were each added without being premixed to the mixer at a rate of about 12% per minute based on the weight of the substantially dry ingredients. The remainder of the formation process was the same as Example 1.

The compositions produced in Examples 2-5 were not subjected to the same testing as the composition of Example 1, but all produced agglomerated granules having uniform available chlorine content. The compositions have been stable for several months.

The present invention may be embodied in other specific forms without departing from the spirit or essential attributes thereof and, accordingly, reference should be made to the appended claims, rather than to the foregoing specification as indicating the scope of the invention.

I claim:

1. A method of making an agglomerated dishwashing composition comprising the steps of:

(a) forming a composition mixture by mixing an aqueous solution of sodium hypochlorite at a rate of about 4 to about 25% per minute based on the total weight of any substantially dry ingredients in an amount sufficient to yield about 0.25 to about 1.6% available chlorine in the composition with at least one alkaline sequestrant builder salt, a water soluble carrier material and an alkali metal silicate having a $SiO_2$ to $M_2O$ ratio of about 1:1 to about 3.22:1 wherein M is at least one alkali metal;

(b) agitating the composition mixture after adding the ingredients set forth in step (a) for a sufficient time to form agglomerated granules of the composition mixture; and (c) conditioning the agglomerated granules by reducing the moisture content of agglomerated granules by about 0.25–5%.

2. A method according to claim 1 wherein the sequestrant builder salt is selected from the group consisting of sodium tripolyphosphate, trisodium phosphate, tetrasodium pyrophosphate, tetrapotassium pyrophosphate, sodium hexametaphosphate and mixtures thereof; the carrier material is selected from the group consisting of sodium chloride, potassium chloride, sodium carbonate, potassium carbonate, sodium sulfate, potassium sulfate, sodium bicarbonate, borax and mixtures thereof; and wherein M is selected from the group consisting of sodium, potassium and mixtures thereof.

3. A method according to claim 1 wherein the sequestrant builder salt is present in an amount of about 30 to about 47%, the carrier material is present in an amount of about 25 to about 40%, and the alkali metal silicate is present in an amount of about 6 to about 24%.

4. A method according to claim 1 further comprising spraying a low foam nonionic surfactant on the conditioned agglomerated granules.

5. A method according to claim 1 wherein the sequestrant builder salt is about 25 to about 35% sodium tripolyphosphate and about 5 to about 12% trisodium phosphate, the carrier material is about 25 to about 40% sodium chloride, the alkali metal silicate is about 6 to about 24% of silicate selected from the group consisting of sodium silicate, potassium silicate and mixtures thereof, and the aqueous solution of sodium hypochlorite is present in a sufficient amount to yield about 0.4 to about 1.2% available chlorine in the composition.

6. A method according to claim 5 wherein agitating step (b) is continued for about 10 seconds to about 5 minutes.

7. A method according to claim 1 wherein a sufficient amount of the aqueous solution of sodium hypochlorite is used to yield about 1% available chlorine in the composition.

8. A method according to claim 1 wherein a sufficient amount of the aqueous solution of sodium hypochlorite is used to yield about 1% available chlorine in the composition and is added at a rate of about 12% per minute based on the total weight of any substantially dry ingredients, the sequestrant builder salt is about 30% sodium tripolyphosphate and about 7% trisodium phosphate, the carrier material is about 34.5% sodium chloride, the alkali metal silicate is present in an amount of about 9.6% derived from about 1.6% of substantially dry alkali metal silicate and about 8% derived from the aqueous solution of alkali metal silicate and is selected from the group consisting of sodium silicate, potassium silicate and mixtures thereof having a $SiO_2$:$M_2O$ ratio of about 2.4:1 wherein M is selected from the group consisting of sodium, potassium and mixtures thereof, the method further comprising spraying about 2% low foam nonionic surfactant on the conditioned agglomerated granules.

9. A method according to claim 1 wherein the alkali metal silicate is a substantially dry ingredient.

10. A method according to claim 9 wherein the sequestrant builder salt, the carrier material and the alkali metal silicate are premixed together to form a relatively homogeneous mixture of substantially dry ingredients.

11. A method according to claim 1 wherein the alkali metal silicate is in the form of an aqueous solution.

12. A method according to claim 11 wherein the aqueous solution of sodium hypochlorite is mixed with the aqueous solution of alkali metal silicate to form a mixed solution, the mixed solution being mixed with the sequestrant builder salt and the carrier material at a rate of about 4 to about 25% per minute based on the weight of the sequestrant builder salt and the carrier material.

13. A method according to claim 12 wherein the sequestrant builder salt and the carrier material are premixed together.

14. A method according to claim 1 wherein a portion of the alkali metal silicate is present in substantially dry form and another portion of the alkali metal silicate is present in the form of an aqueous solution, the aqueous solution of alkali metal silicate being mixed with the aqueous solution of sodium hypochlorite to form a mixed solution and the mixed solution is added to the sequestrant builder salt, the carrier material and the substantially dry portion of alkali metal silicate.

15. A method of making a dishwashing composition comprising the steps of:

(a) mixing together substantially dry ingredients including about 30% to about 47% alkaline sequestrant builder salt, about 25% to about 40% water soluble carrier material and alkali metal silicate selected from the group consisting of sodium silicate, potassium silicate and mixtures thereof having a $SiO_2$:$M_2O$ ratio of about 1:1 to about 3.22:1 wherein M is selected from the group consisting of sodium, potassium and mixtures thereof;

(b) mixing together liquid ingredients including an aqueous solution of sodium hypochlorite sufficient to yield about 0.25% to about 1.6% available chlorine in the composition and an aqueous solution of alkali metal silicate selected from the group consisting of sodium silicate, potassium silicate and mixtures thereof, whereby the composition will contain a total of about 6% to about 24% alkali metal silicate from the substantially dry and liquid alkali metal silicate ingredients;

(c) adding the mixed liquid ingredients to said mixed substantially dry ingredients at a rate of about 4% per minute to about 25% per minute based on the weight of said mixed substantially dry ingredients to form the composition mixture;

(d) agitating the composition mixture after completing the addition step (c) to form agglomerated granules of the composition mixture; and (e) conditioning the agglomerated granules by reducing their moisture content by about 0.25–5%.

16. A method according to claim 15 wherein the total amount of alkali metal silicate in the composition is derived from about 1% to about 10% of the substantially dry alkali metal silicate and about 5% to about 14% of the aqueous solution of alkali metal silicate.

17. A method according to claim 15 further comprising spraying about 1% to about 4% of a low foam nonionic surfactant on the conditioned agglomerated granules.

18. A method according to claim 17 wherein the sequestrant builder salt is selected from the group consisting of sodium tripolyphosphate, trisodium phosphate, tetrasodium pyrophosphate, tetrapotassium pyrophosphate, sodium hexametaphosphate and mixtures thereof; the carrier material is selected from the group consisting of sodium chloride, potassium chloride, sodium carbonate, potassium carbonate, sodium sulfate, potassium sulfate, sodium bicarbonate, borax and mixtures thereof; and said agitating step (d) continues for about 10 seconds to about 5 minutes after completing the addition step (c).

19. A method according to claim 18 wherein the sequestrant builder salt is about 25% to about 35% sodium tripolyphosphate and about 5% to about 12% trisodium phosphate, the carrier material is sodium chloride, the aqueous solution of sodium hypochlorite is present in an amount to yield about 0.4% to about 1.2% available chlorine in the composition, and the total amount of alkali metal silicate in the composition is derived from about 1% to about 10% substantially dry alkali metal silicate and from about 5% to about 14% of the aqueous solution of alkali metal silicate.

20. A method according to claim 17 wherein said sequestrant builder salt includes about 30% sodium tripolyphosphate and about 7% trisodium phosphate, said carrier material so includes about 34.5% sodium chloride, the total amount of alkali metal silicate in the composition is about 9.6% derived from about 1.6% of substantially dry sodium silicate and about 8% derived from an aqueous solution of sodium silicate, said sodium silicate having a $SiO_2$:$Na_2O$ ratio of about 2.4:1, the mixed liquid ingredients are added to the mixed substantially dry ingredients at a rate of about 12% per minute based on the weight of the mixed substantially dry ingredients, the the composition mixture is agitated for about one minute after completing the addition of the liquid ingredients to the substantially dry ingredients, the moisture content of the composition is reduced from about 15% to about 14%, and about 2% of a low foam nonionic surfactant is sprayed on the conditioned particles of the composition.

21. A dishwashing composition made according to the method of any one of claims 1–20.

* * * * *